US009453581B1

(12) United States Patent
Fain

(10) Patent No.: US 9,453,581 B1
(45) Date of Patent: Sep. 27, 2016

(54) MODULAR BACKFLOW PREVENTION SYSTEM

(71) Applicant: Legend Ideas LLC, Houston, TX (US)

(72) Inventor: Johnny Dale Fain, Montgomery, TX (US)

(73) Assignee: LEGEND IDEAS LLC, Houston, TX (US)

( * ) Notice: Subject to any disclaimer, the term of this patent is extended or adjusted under 35 U.S.C. 154(b) by 16 days.

(21) Appl. No.: 14/680,592

(22) Filed: Apr. 7, 2015

(51) Int. Cl.
*F16K 15/04* (2006.01)

(52) U.S. Cl.
CPC ..... *F16K 15/04* (2013.01); *Y10T 137/0447* (2015.04); *Y10T 137/87917* (2015.04)

(58) Field of Classification Search
CPC ..... F16K 15/04; Y10T 137/0441; Y10T 137/0447; Y10T 137/0486; Y10T 137/0508; Y10T 137/0491; Y10T 137/6031; Y10T 137/6035; Y10T 137/87917; Y10T 137/9029; Y10T 137/5283; Y10T 137/87265; Y10T 137/87273; Y10T 137/87555; F16L 55/07
USPC ..... 137/15, 15.09, 15.17, 15.22, 15.18, 137/315.17, 315.18, 613, 271, 137/599.01–599.02, 601.2, 15.08, 798; 285/12, 15
See application file for complete search history.

(56) References Cited

U.S. PATENT DOCUMENTS 4,186,475 A * 2/1980 Jonsson ..... F16L 19/061 137/15.09
7,121,293 B2 * 10/2006 Walter ..... E03B 7/077 137/15.01
2005/0252560 A1 * 11/2005 Anderson ..... F16K 11/0876 137/625.47
2008/0314451 A1 * 12/2008 Matos ..... F17D 1/086 137/2

* cited by examiner

*Primary Examiner* — Michael R Reid
(74) *Attorney, Agent, or Firm* — Basil M. Angelo

(57) ABSTRACT

A modular backflow prevention system for a sprinkler system includes a first fixed union end piece attached to a first end of a fixed water inlet pipe through a first union mating adapter where a second end of the fixed water inlet pipe is in fluid communication with a water supply. A fixed union end piece with seal is attached to a first end of a fixed water outlet pipe where a second end of the fixed water outlet pipe is in fluid communication with the sprinkler system. A removably backflow prevention assembly is removably attached to the first end of the fixed water inlet pipe and the first end of the fixed water outlet pipe by removably attaching a second union mating adapter to a second union end of an inline ball valve and removably attaching a third union mating adapter to the fixed union end piece with seal.

8 Claims, 12 Drawing Sheets

MODULAR BACKFLOW PREVENTION SYSTEM

BACKGROUND OF THE INVENTION

In climates that do not provide sufficient rainfall, irrigation is required to maintain the health and the appearance of the landscape. Automated sprinkler systems are commonly installed in residential and commercial properties to provide sufficient irrigation in a manner that conserves water. An automated sprinkler system typically draws water from a water supply and distributes it through a number of sprinkler heads or other water dispersing devices. The water used by a sprinkler system may be drawn from a water district that provides potable water to a community or a private well system that provides potable water to a property.

Various state laws and local regulations govern measures that must be taken to protect the water supply from which water is drawn. For example, the Texas Commission on Environmental Quality requires that sprinkler systems connect to the water supply through backflow prevention assemblies that prevent water from flowing back to the water supply (backsiphonage). In a sprinkler system, a backflow prevention assembly prevents stagnant water from the sprinkler system from being drawn back into the potable water supply to protect it from contamination.

A backflow prevention assembly typically includes an inlet shutoff valve, a backflow preventer, and an outlet shutoff valve and any piping that may fluidly connect them. The backflow preventer is typically required to be installed above ground, at least 12 inches above the highest point of the sprinkler system and installed vertically with respect to the pipe through which water is drawn. Commercially available backflow preventers and backflow prevention assemblies that are commonly used in sprinkler systems include those manufactured by Febco®, Apollo®, and Zurn®.

BRIEF SUMMARY OF THE INVENTION

According to one aspect of one or more embodiments of the present invention, a modular backflow prevention system for a sprinkler system includes a first fixed union end piece attached to a first end of a fixed water inlet pipe through a first union mating adapter where a second end of the fixed water inlet pipe is in fluid communication with a water supply. A fixed union end piece with seal is attached to a first end of a fixed water outlet pipe where a second end of the fixed water outlet pipe is in fluid communication with the sprinkler system. An inline ball valve includes a first union end removably attached to the first union mating adapter. A removable backflow prevention assembly includes a backflow preventer that includes an inlet port and an outlet port, an inlet shutoff valve where a first port of the inlet shutoff valve is in fluid communication with the inlet port of the backflow preventer, an outlet shutoff valve where a first port of the outlet shutoff valve is in fluid communication with the outlet port of the backflow preventer, a removable water inlet pipe where a first end of the removable water inlet pipe is in fluid communication with a second port of the inlet shutoff valve and a second end of the removable water inlet pipe is attached to a second fixed union end piece through a second union mating adapter, and a removable water outlet pipe where a first end of the removable water outlet pipe is in fluid communication with a second port of the outlet shutoff valve and a second end of the removable water outlet pipe is attached to a third fixed union end piece through a third union mating adapter. The removable backflow prevention assembly is removably attached to the first end of the fixed water inlet pipe and the first end of the fixed water outlet pipe by removably attaching the second union mating adapter to a second union end of the inline ball valve and removably attaching the third union mating adapter to the fixed union end piece with seal.

According to one aspect of one or more embodiments of the present invention, a method of modularizing a backflow prevention assembly of a sprinkler system includes cutting a water inlet pipe forming a fixed water inlet pipe and a removable water inlet pipe. A water outlet pipe is cut forming a fixed water outlet pipe and a removable water outlet pipe. The backflow prevention assembly is removed. A first fixed union end piece is attached to a first end of the fixed water inlet pipe through a first union mating adapter where a second end of the fixed water inlet pipe is in fluid communication with a water supply. A first union end of an inline ball valve is removably attached to the first union mating adapter. A first fixed union end piece with seal is attached to a first end of the fixed water outlet pipe where a second end of the fixed water outlet pipe is in fluid communication with the sprinkler system. A second fixed union end piece is attached to a second end of the removable water inlet pipe through a second union mating adapter. A third fixed union end piece is attached to a second end of the removable water outlet pipe through a third union mating adapter.

Other aspects of the present invention will be apparent from the following description and claims.

DETAILED DESCRIPTION OF THE INVENTION

Figure 1:
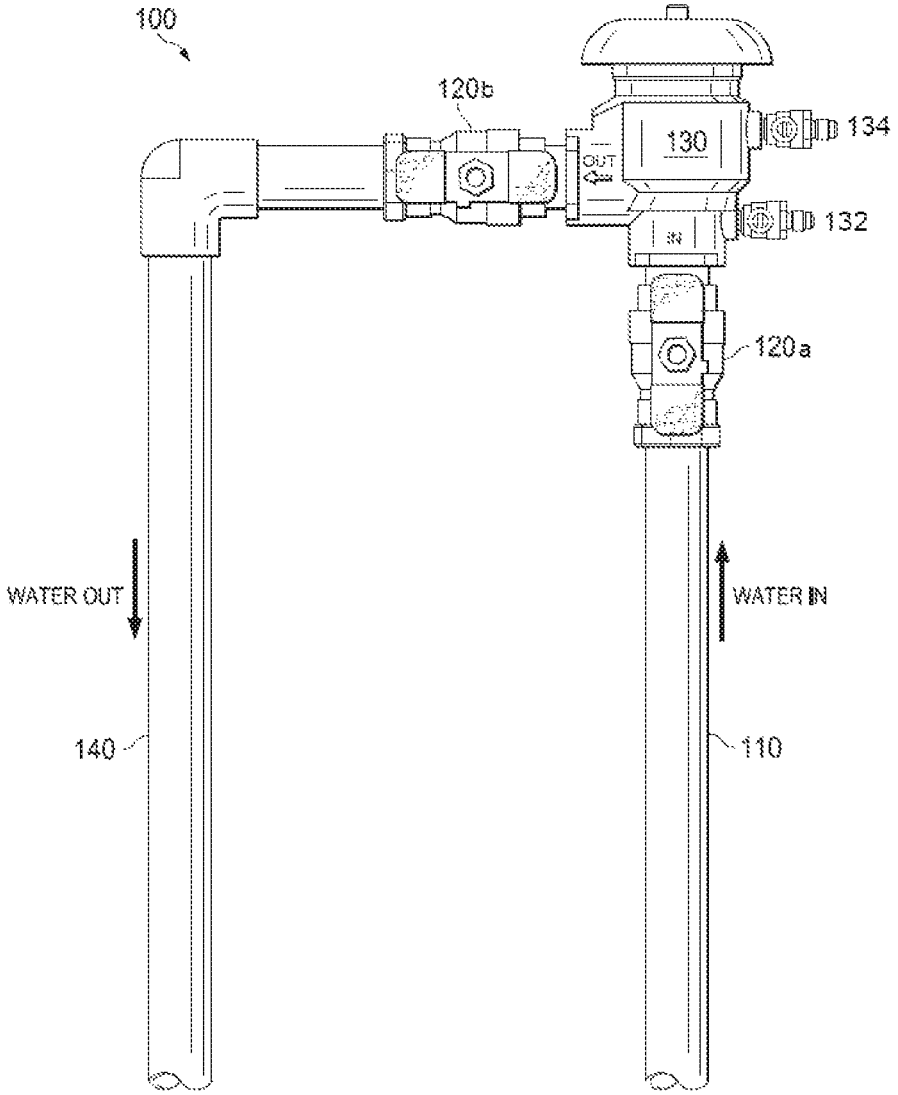
FIG. 1 PRIOR ART
FIG. 1 shows a conventional backflow prevention assembly for a sprinkler system in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

Backflow preventers and backflow prevention assemblies are prone to failure in freezing conditions. When water in the backflow preventer freezes, the frozen water expands volumetrically and can damage one or more of the internal components of the backflow preventer or the housing body of the backflow preventer itself. A damaged backflow preventer may leak water and there is typically no protection against backsiphonage and contamination of the potable water supply. While manufacturers of backflow preventers and backflow prevention assemblies endeavor to manufacture products that can withstand the cold, they are still prone to failure in freezing conditions. As such, most manufacturers recommend procedures for draining their backflow preventers or backflow prevention assemblies to protect against freezing conditions. These complicated procedures typically include a number of process steps that must be performed in a specific order and require some measure of expertise.

For example, the most common type of backflow preventer used in sprinkler systems is the pressure vacuum breaker ("PVB") backflow preventer. A conventional PVB backflow preventer typically includes a housing body, first test cock, a check valve, a second test cock, an air inlet valve, and a canopy. A conventional PVB backflow prevention assembly includes an inlet shutoff valve, a PVB backflow preventer, and an outlet shutoff valve. A conventional procedure to drain a PVB backflow prevention assembly may include turning off the master shutoff valve to the house, opening any inlet or outlet drain valves that may be disposed before or after the PVB backflow prevention assembly, opening the inlet and outlet shutoff valves, opening the first and second test cocks, and potentially introducing air into an outlet drain valve to flush the downstream sprinkler system of water. Because of the complexity of the procedure, many homeowners fail to drain the PVB backflow prevention assembly properly and others do not even attempt to drain it at all. Those that do not attempt to drain it may instead opt to wrap the backflow prevention assembly in an effort to protect it from freezing. However, these efforts are typically not sufficient to protect the backflow preventer or the backflow prevention assembly from freezing and, ultimately, they remain prone to failure. Moreover, even in situations where the backflow preventer and backflow prevention assembly are drained properly, the exposure to freezing conditions may stress the mechanical strength of the backflow preventer or backflow prevention assembly over time also resulting in failure.

Accordingly, in one or more embodiments of the present invention, a modular backflow prevention system for a sprinkler system allows for the removal of a removable backflow prevention assembly such that it may be taken inside a garage or house to provide full-proof protection against damage from freezing weather conditions. When the homeowner wishes to use the sprinkler system, the removable backflow prevention system may be easily reinstalled allowing the sprinkler system to be used in its normal operating mode. In addition, in one or more embodiments of the present invention, a method of modularizing a backflow prevention assembly allows for the conversion of a conventional backflow prevention assembly into a removable backflow prevention assembly.

FIG. 1 shows a conventional backflow prevention system 100 for a sprinkler system (not shown) in accordance with one or more embodiments of the present invention. Backflow prevention system 100 includes a water inlet pipe 110, an inlet shutoff valve 120*a*, a backflow preventer 130, an outlet shutoff valve 120*b*, a water outlet pipe 140, and any other piping that may fluidly connect them. The inlet shutoff valve 120*a*, the backflow preventer 130, and the outlet shutoff valve 120*b* and any piping that may fluidly connect them are referred to collectively as a backflow prevention assembly. The water inlet pipe 110 is in fluid communication with a water supply (not shown) that provides water, through the backflow prevention assembly, to the water outlet pipe 140. The water outlet pipe 140 is in fluid communication with the downstream sprinkler system that disperses water over the landscape.

The backflow preventer 130 prevents stagnant water from the downstream sprinkler system from returning to the water supply thereby protecting it from contamination. As noted above, state laws and local regulations typically require that the backflow preventer 130 be disposed at least 12 inches above the ground and installed vertically with respect to the water inlet pipe 110. In certain embodiments, backflow preventer 130 may be a PVB-type backflow preventer. In other embodiments, backflow preventer 130 may be a double check valve-type backflow preventer. In still other embodiments, backflow preventer 130 may be a reduced pressure zone-type backflow preventer. One of ordinary skill in the art will recognize that other types of backflow preventers may be used in accordance with one or more embodiments of the present invention.

Figure 2:
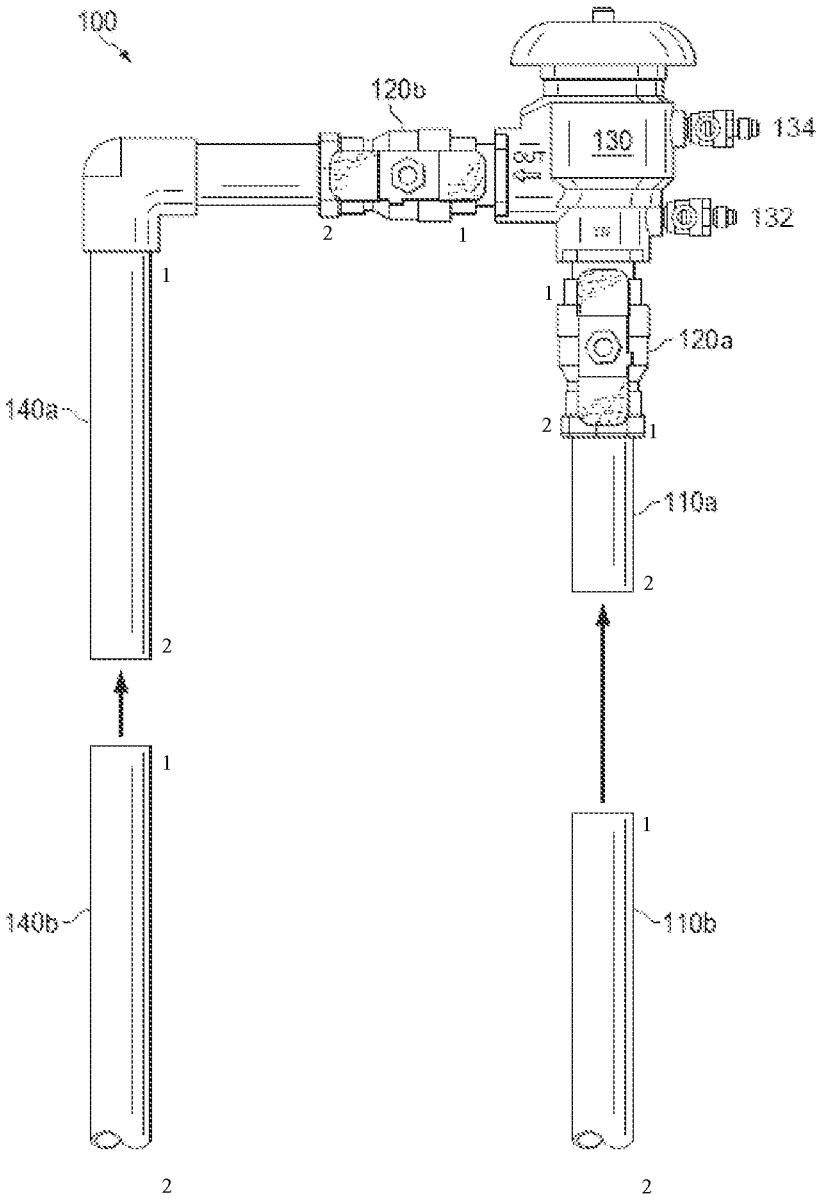
FIG. 2 shows the water inlet and water outlet pipes cut such that the backflow prevention assembly may be removed in accordance with one or more embodiments of the present invention.

FIG. 2 shows the water inlet (110 of FIG. 1) and water outlet (140 of FIG. 1) pipes cut such that the backflow prevention assembly may be removed in accordance with one or more embodiments of the present invention. Prior to cutting the pipes, water may be evacuated, to the extent possible, from the backflow prevention system 100. In certain embodiments, water may be evacuated from the system 100 by turning off a master shutoff valve (not shown) to the property, running the sprinkler system to evacuate any downstream water, and opening the test cocks 132 and 134 to drain any remaining water that may be in the backflow preventer 130. One of ordinary skill in the art will recognize that the procedure used to evacuate water may vary based on the type of backflow preventer 130 in use. One of ordinary skill in the art will also recognize that any other procedure suitable for evacuating water may be used in accordance with one or more embodiments of the present invention.

In certain embodiments, the water inlet (110 of FIG. 1) and water outlet (140 of FIG. 1) pipes may be composed of polyvinyl chloride, commonly referred to as PVC. In other embodiments, they may be composed of steel. In still other embodiments, they may be composed of copper. One of ordinary skill in the art will recognize that water inlet pipe (110 of FIG. 1) and water outlet (140 of FIG. 1) pipes may be composed of other materials in accordance with one or more embodiments of the present invention. The water inlet pipe (110 of FIG. 1) may be cut, or partitioned, forming a removable water inlet pipe 110*a* and a fixed water inlet pipe 110*b* that typically includes a second end that is fixed in the ground. The second end of the fixed water inlet pipe 110*b* is in fluid communication with the water supply (not shown). The water outlet pipe (140 of FIG. 1) may be cut forming a removable water outlet pipe 140*a* and a fixed water outlet pipe 140*b* that typically includes a second end that is fixed in the ground. The second end of the fixed water outlet pipe 140*b* is in fluid communication with the sprinkler system (not shown). The pipes may be cut using any implement suitable for cutting a given composition of pipe including, for example, a wire saw, a miter saw, or a pipe cutter. Once the cuts are made, the backflow prevention assembly, including removable water inlet pipe 110*a*, inlet shutoff valve 120*a*, backflow preventer 130, outlet shutoff valve 120*b*, removable water outlet pipe 140*a*, and any other piping that may fluidly connect them, may be removed. An additional length (not shown) of the water inlet pipe (110*a* and/or 110*b*) may be removed, as needed, to accommodate the additional height of components (e.g., an inline ball valve) that may later be placed in line between the fixed water inlet pipe 110*b* and the removable water inlet pipe 110*a* as discussed in more detail herein.

Figure 3A:
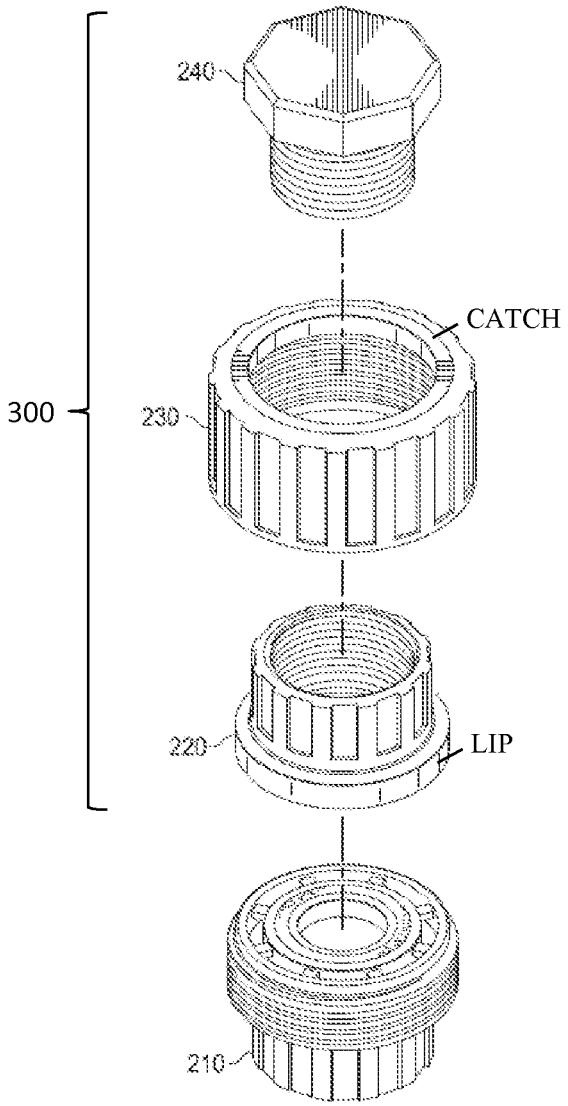
FIG. 3A shows a top-perspective exploded view of a fixed union end piece with seal and a capping assembly in accordance with one or more embodiments of the present invention.

FIG. 3A shows a top-perspective exploded view of a fixed union end piece with seal 210 and a capping assembly 300 in accordance with one or more embodiments of the present invention. Fixed union end piece with seal 210 has a bottom distal end (not shown) that includes an unthreaded aperture (not shown) configured for attachment to a pipe (not shown) and the flow of fluid. A top distal end of the fixed union end piece with seal 210 includes an aperture for fluid flow and a seal disposed around the aperture. An edge of the top distal end of the fixed union end piece with seal 210 includes threading configured for mating with a union mating adapter 230. A removable union end piece 220 has a bottom distal end (not shown) that includes an aperture and a flat surface configured to removably form a sealed aperture when placed in contact with the top distal end of a fixed union end piece with seal 210. A top distal end of the removable union end piece 220 includes a threaded aperture. An edge of the bottom distal end of the removable union end piece 220 includes a lip configured to allow at least a portion of the threaded aperture of the removable union end piece 220 to extend through an aperture of a union mating adapter 230, while a catch of the union mating adapter 230 holds the removable union end piece 220 in place when removably secured to, for example, fixed union end piece with seal 210. A removable cap 240 includes threading configured for mating with the threaded aperture of a removable union end piece 220.

Figure 3B:
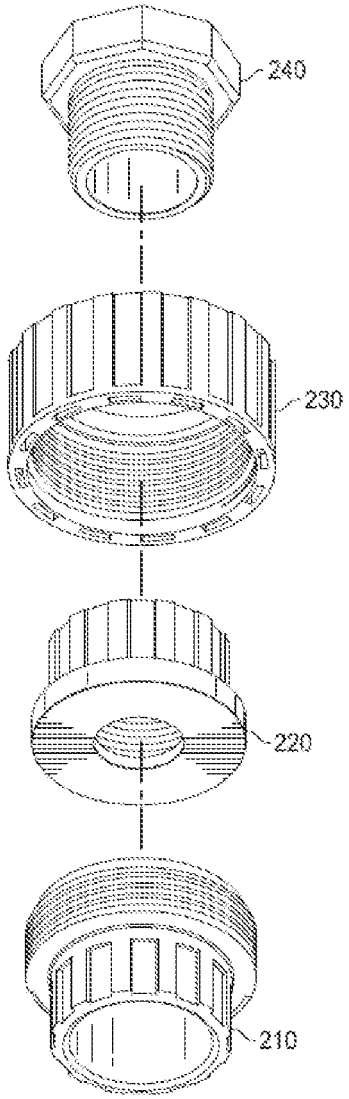
FIG. 3B shows a bottom-perspective exploded view of a fixed union end piece with seal and a capping assembly in accordance with one or more embodiments of the present invention.

FIG. 3B shows a bottom-perspective exploded view of a fixed union end piece with seal 210 and a capping assembly 300 in accordance with one or more embodiments of the present invention. Fixed union end piece with seal 210 has a bottom distal end that includes an unthreaded aperture configured for attachment to a pipe (not shown) and the flow of fluid. A top distal end (not shown) of the fixed union end piece with seal 210 includes an aperture for fluid flow and a seal disposed around the aperture. An edge of the top distal end of the fixed union end piece with seal 210 includes threading configured for mating with a union mating adapter 230. Removable union end piece 220 has a bottom distal end that includes an aperture and a flat surface configured to removably form a sealed aperture when placed in contact with the top distal end (not shown) of a fixed union end piece with seal 210. A top distal end (not shown) of the removable union end piece 220 includes a threaded aperture. An edge of the bottom distal end of the removable union end piece 220 includes a lip configured to allow at least a portion of the threaded aperture of the removable union end piece 220 to extend through an aperture of a union mating adapter 230, while a catch of the union mating adapter 230 holds the removable union end piece 220 in place when removably secured to, for example, fixed union end piece with seal 210. A removable cap 240 includes threading configured for mating with the threaded aperture of a removable union end piece 220.

Figure 4:
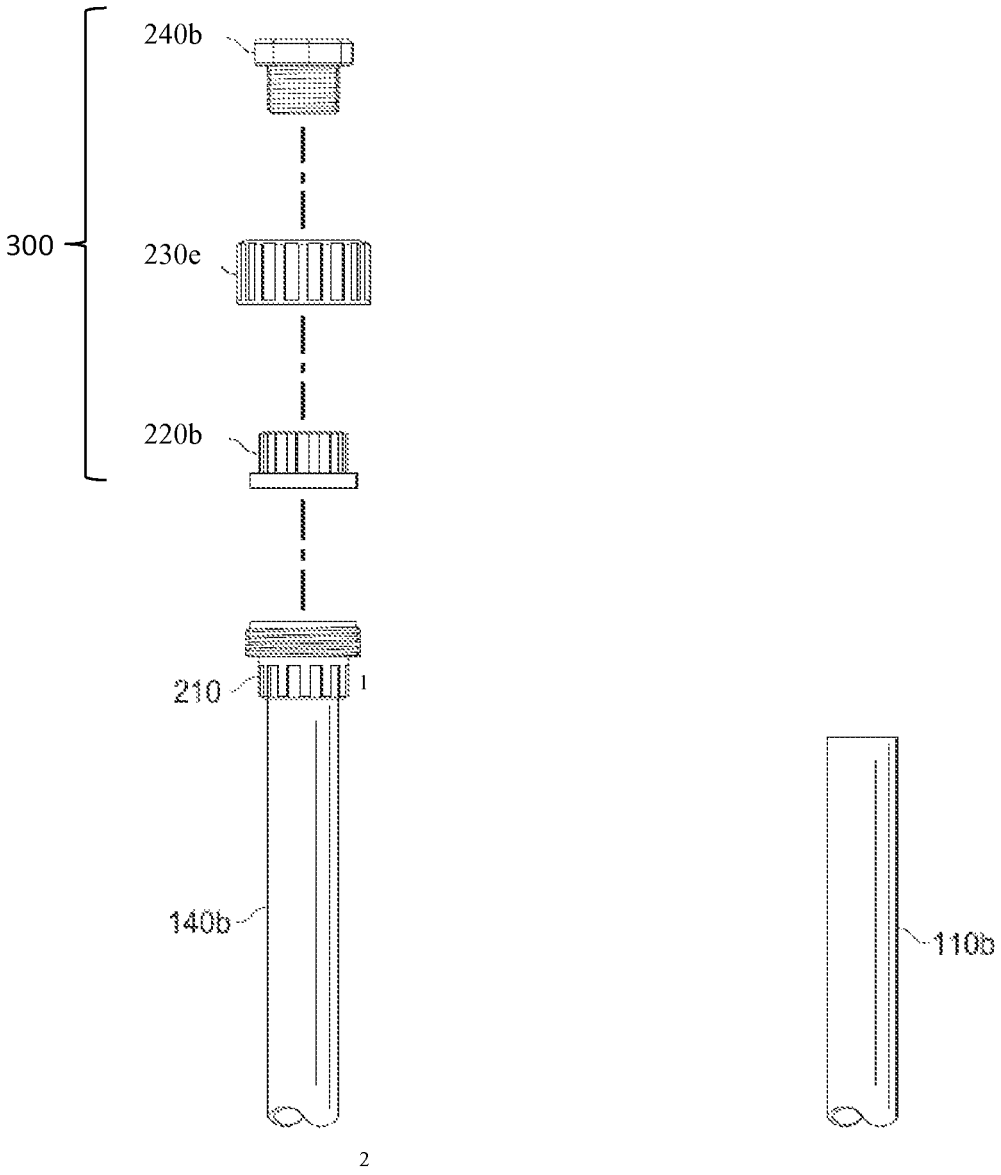
FIG. 4 shows an exploded view of a fixed union end piece with seal and a capping assembly for the fixed water outlet pipe in accordance with one or more embodiments of the present invention.

FIG. 4 shows an exploded view of a fixed union end piece with seal 210 and a capping assembly 300 for the fixed water outlet pipe 140*b* in accordance with one or more embodiments of the present invention. A fixed union end piece with seal 210 may be fixedly attached to a first end of the fixed water outlet pipe 140*b* by, for example, disposing glue (not shown) around an exterior of the first end of fixed water outlet pipe 140*b* and inserting the first end of the fixed water outlet pipe 140*b* into the aperture of the bottom distal end of the fixed union end piece with seal 210. A removable cap 240*b* may be removably attached to a removable union end piece 220*b* through a union mating adapter 230*e* by screwing the removable cap 240*b* into the threaded aperture of the removable union end piece 220*b*. Union mating adapter 230*e* may be removably attached to fixed union end piece with seal 210 by screwing the union mating adapter 230*e* around the fixed union end piece with seal 210, thereby removably securing the removable union end piece 220*b* in place and forming a seal.

Figure 5A:
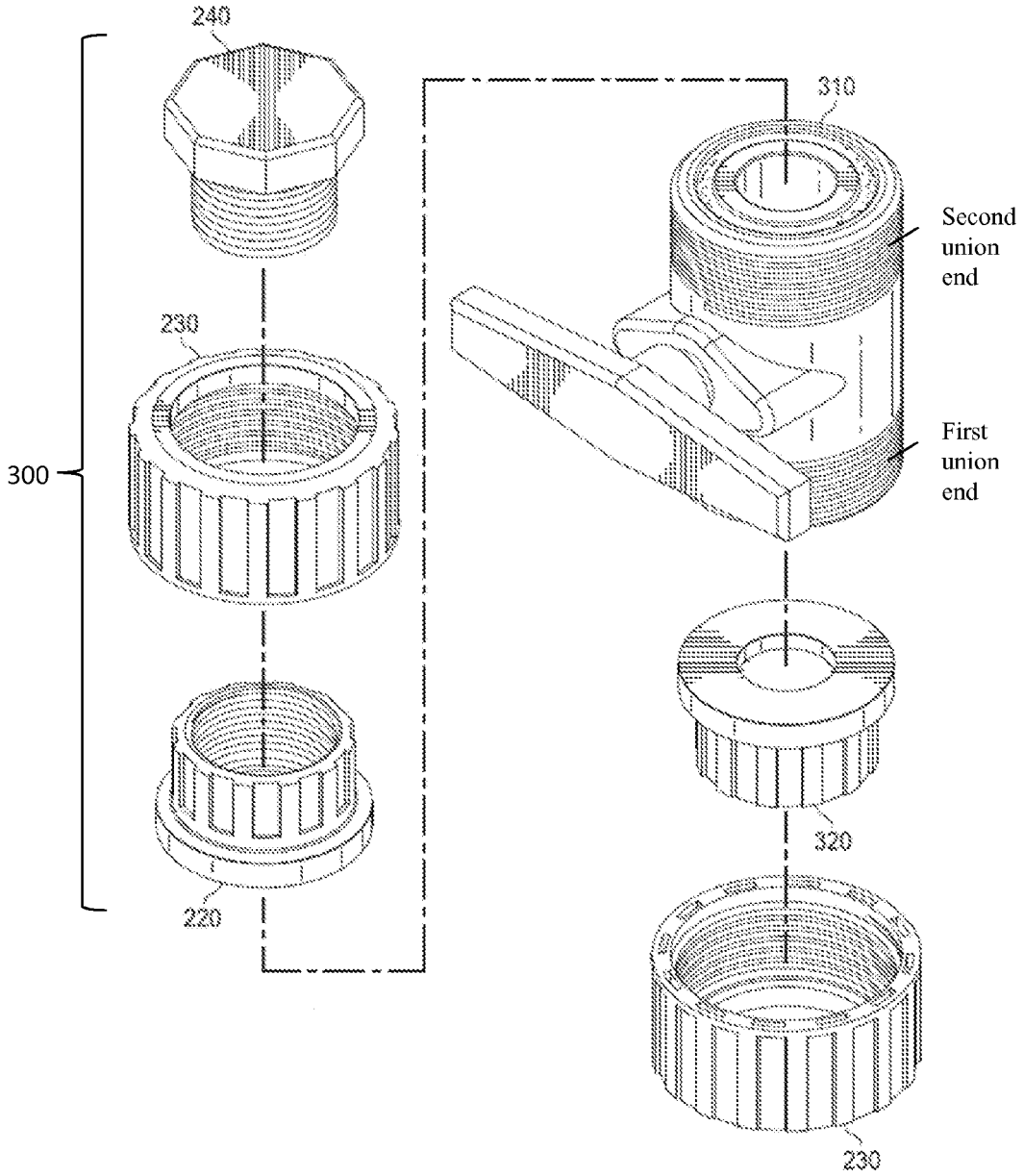
FIG. 5A shows a top-perspective exploded view of a fixed union end piece, an inline ball valve, and a capping assembly in accordance with one or more embodiments of the present invention.

FIG. 5A shows a top-perspective exploded view of a fixed union end piece 320, an inline ball valve 310, and a capping assembly 300 in accordance with one or more embodiments of the present invention. Fixed union end piece 320 has a bottom distal end (not shown) that includes an unthreaded aperture (not shown) configured for attachment to a pipe (not shown) through a union mating adapter 230. The fixed union end piece 320 may be fixedly attached to a first end of the fixed water inlet pipe (110*b* of FIG. 2) by, for example, disposing glue (not shown) around an exterior of the first end of the fixed water inlet pipe (110*b* of FIG. 2) and inserting the first end of the fixed water inlet pipe (110*b* of FIG. 2) into the aperture of the bottom distal end (not shown) of the fixed union end piece 320. Once the fixed union end piece 320 is fixedly attached to a pipe through a union mating adapter 230, the union mating adapter 230 includes a threaded aperture that may connect to a union end such as, for example, a first union end (partially shown) of inline ball valve 310.

The first union end (partially shown) of inline ball valve 310 includes an aperture (not shown) for fluid flow and a seal (not shown) disposed around the aperture. An edge of the first union end of inline ball valve 310 includes threading configured for mating with a union mating adapter 230 such that inline ball valve 310 may be removably attached to a union mating adapter 230. A removable union end piece 220 has a bottom distal end (not shown) that includes an aperture (not shown) and a flat surface (not shown) configured to removably form a sealed aperture when placed in contact with a second union end of inline ball valve 310. A top distal end of the removable union end piece 220 includes a threaded aperture. An edge of the bottom distal end of the removable union end piece 220 includes a lip configured to allow at least a portion of the threaded aperture of the removable union end piece 220 to extend through an aperture of a union mating adapter 230, while a catch of the union mating adapter 230 holds the removable union end piece 220 in place when adapter 230 is removably secured to, for example, the second union end of inline ball valve 310. A removable cap 240 includes threading configured for mating with the threaded aperture of a removable union end piece 220.

Figure 5B:
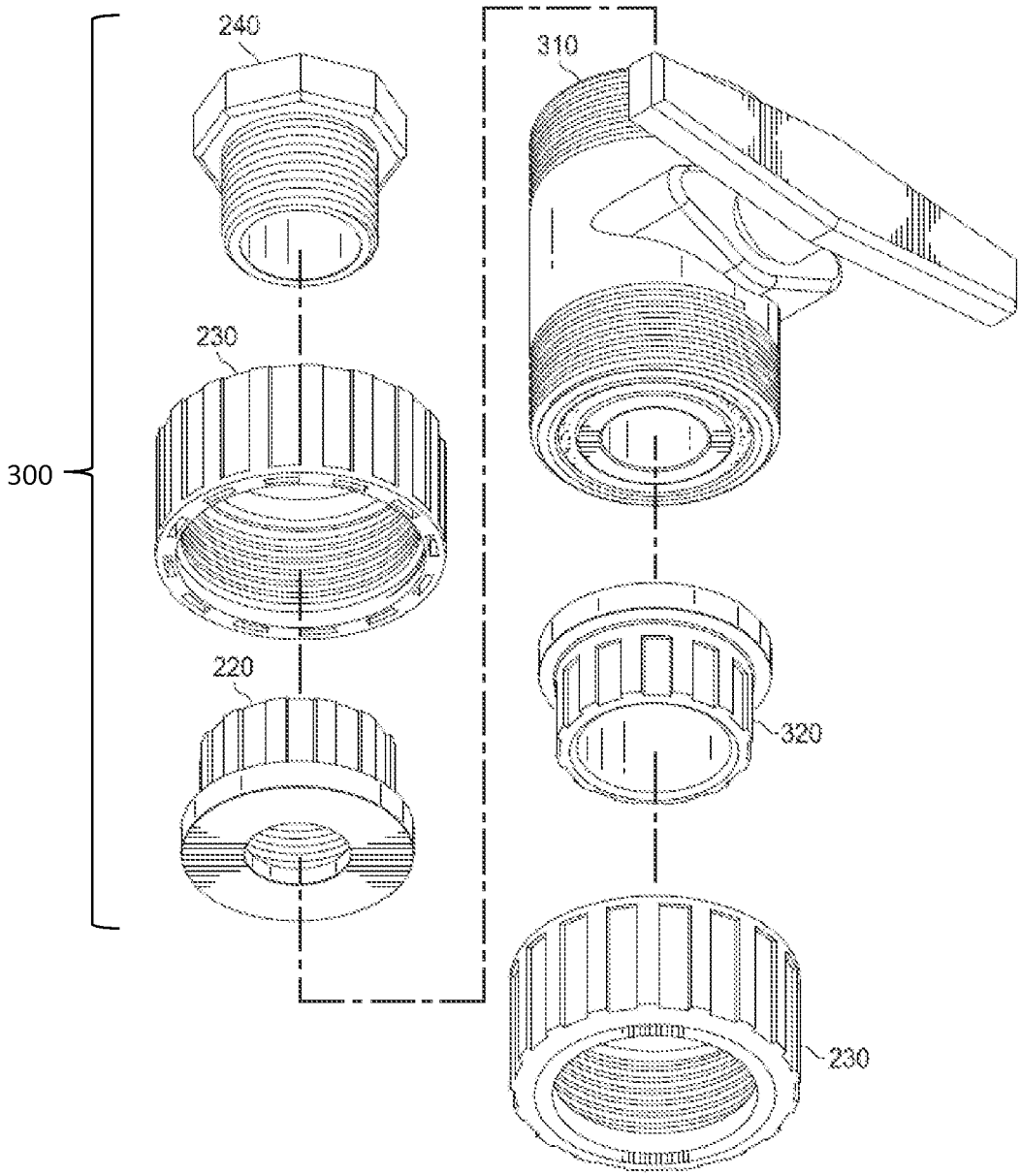
FIG. 5B shows a bottom-perspective exploded view of a fixed union end piece, an inline ball valve, and a capping assembly in accordance with one or more embodiments of the present invention.

FIG. 5B shows a bottom-perspective exploded view of a fixed union end piece 320, an inline ball valve 310, and a capping assembly 300 in accordance with one or more embodiments of the present invention. Fixed union end piece 320 has a bottom distal end that includes an unthreaded aperture configured for attachment to a pipe (not shown) through a union mating adapter 230. The first union end piece 320 may be fixedly attached to a first end of the fixed water inlet pipe (110*b* of FIG. 2) by, for example, disposing glue (not shown) around an exterior of the first end of the fixed water inlet pipe (110*b* of FIG. 2) and inserting the first end of the fixed water inlet pipe (110*b* of FIG. 2) into the aperture of the bottom distal end (not shown) of the fixed union end piece 320. Once the fixed union end piece 320 is fixedly attached to a pipe through a union mating adapter 230, the union mating adapter 230 includes a threaded aperture that may connect to a union end such as, for example, a first union end of inline ball valve 310.

The first union end of inline ball valve 310 includes an aperture for fluid flow and a seal disposed around the aperture. An edge of the first union end of inline ball valve 310 includes threading configured for mating with a union mating adapter 230 such that inline ball valve 310 may be removably attached to a union mating adapter 230. A removable union end piece 220 has a bottom distal end that includes an aperture and a flat surface configured to removably form a sealed aperture when placed in contact with a second union end (partially shown) of inline ball valve 310. A top distal end (not shown) of the removable union end piece 220 includes a threaded aperture. An edge of the bottom distal end of the removable union end piece 220 includes a lip configured to allow at least a portion of the threaded aperture of the removable union end piece 220 to extend through an aperture of a union mating adapter 230, while a catch of the union mating adapter 230 holds the removable union end piece 220 in place when adapter 230 is removably secured to, for example, the second union end of inline ball valve 310. A removable cap 240 includes threading configured for mating with the threaded aperture of a removable union end piece 220.

Figure 6:
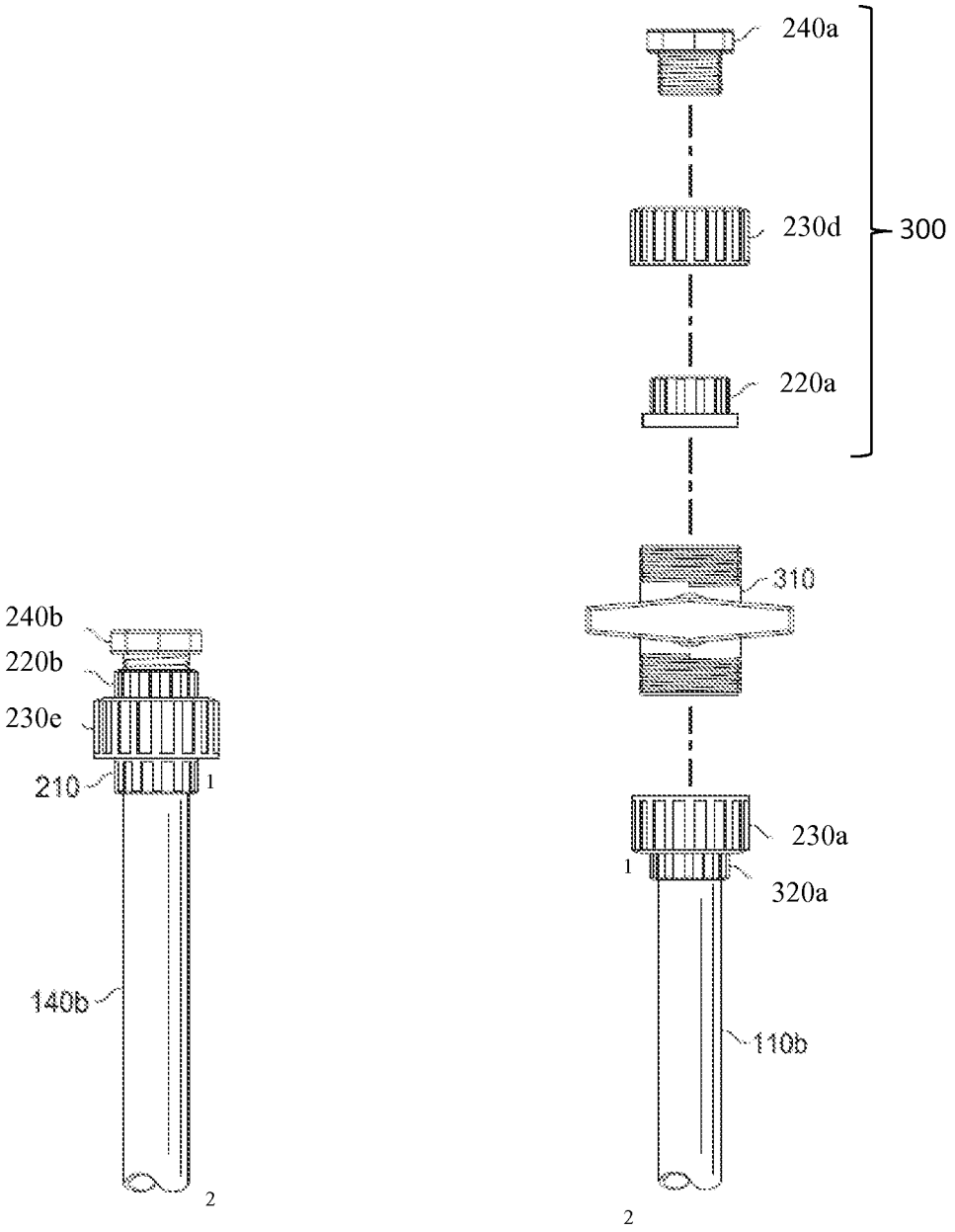
FIG. 6 shows an exploded view of a fixed union end piece, an inline ball valve, and a capping assembly for the fixed water inlet pipe in accordance with one or more embodiments of the present invention.

FIG. 6 shows an exploded view of a fixed union end piece 320*a*, an inline ball valve 310, and a capping assembly 300 for the fixed water inlet pipe 110*b* in accordance with one or more embodiments of the present invention. A fixed union end piece 320*a* may be fixedly attached to a first end of the fixed water inlet pipe 110*b* by, for example, disposing glue (not shown) around an exterior of the first end of the fixed water inlet pipe 110*b* and inserting the first end of the fixed water inlet pipe 110*b* into the aperture of the bottom distal end of the fixed union end piece 320*a* through an aperture of the union mating adapter 230*a*. A first union end of the inline ball valve 310 may be removably attached to the union mating adapter 230*a* by screwing the first union end of the inline ball valve 310 and the union mating adapter 230*a* together. A removable cap 240*a* may be removably attached to a removable union end piece 220*a* through another union mating adapter 230*d* by screwing the removable cap 240*a* into the threaded aperture of the removable union end piece 220*a*. Union mating adapter 230*d* may be removably attached to a second union end of inline ball valve 310 by screwing the union mating adapter 230*d* and second union end of inline ball valve 310 together, thereby removably securing the removable union end piece 220*a* in place and forming a seal.

Figure 7:
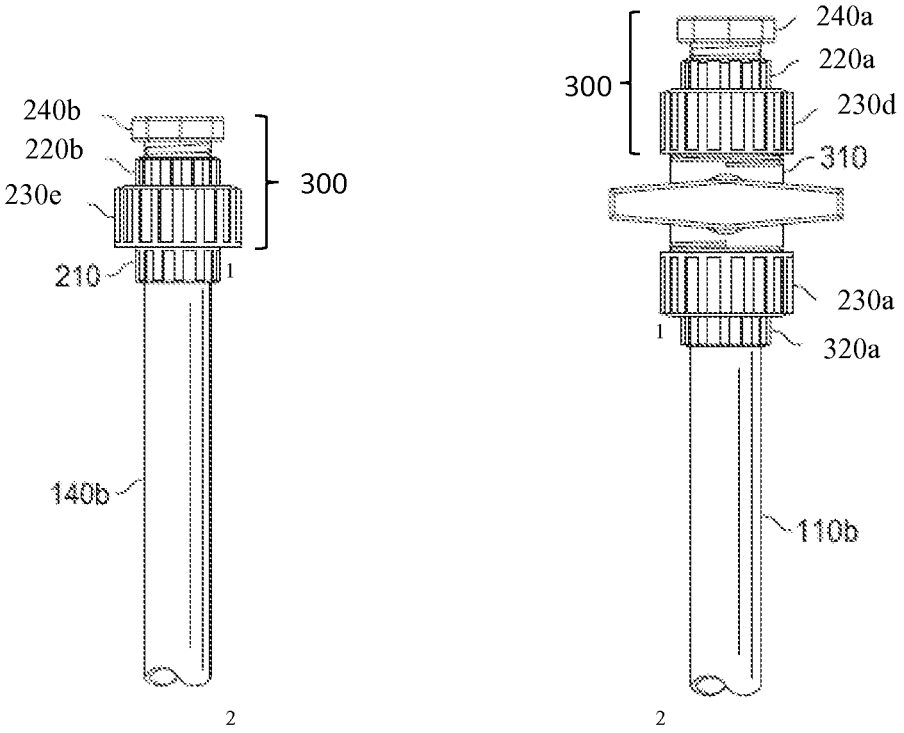
FIG. 7 shows the fixed water inlet pipe and the fixed water outlet pipe capped off in accordance with one or more embodiments of the present invention.

FIG. 7 shows the fixed water inlet pipe 110*b* and the fixed water outlet pipe 140*b* capped 300 off in accordance with one or more embodiments of the present invention. When the removable backflow prevention assembly (not shown) is removed for storage during periods of cold weather, the fixed water inlet pipe 110*b* and the fixed water outlet pipe 140*b* may be capped off with capping assemblies 300. The inline ball valve 310 may be placed in the closed position preventing water from flowing when the master shutoff valve (not shown) is reopened to provide water elsewhere. The fixed water inlet pipe 110*b* may be capped off by a capping assembly 300 that includes a removable cap 240*a* removably attached to a removable union end piece 220*a* extended through a union mating adapter 230*d*, where the union mating adapter 230*d* is removably attached to the second union end of the inline ball valve 310. The fixed water outlet pipe 140*b* may be capped off by a capping assembly 300 that includes another removable cap 240*b* removably attached to another removable union end piece 220*b* extended through another union mating adapter 230*e*, where the union mating adapter 230*e* is removably attached to the fixed union end piece with seal 210 that is fixedly attached to a first end of the fixed water outlet pipe 140*b*. Once capped off, the master shutoff valve (not shown) may be reopened allowing water to flow elsewhere and the closed inline ball valve 310 and capping assemblies 300 prevent undesired water flow in the sprinkler system. In certain embodiments, the fixed water inlet pipe 110*b* capped by the fixed water inlet pipe capping assembly 300 may be covered by an insulation sock, container, or wrap (not shown) that protects the fixed water inlet pipe from freezing. One of ordinary skill in the art will recognize that the insulation sock container, or wrap may be comprised of any material suitable for insulating the live water line.

Figure 8:
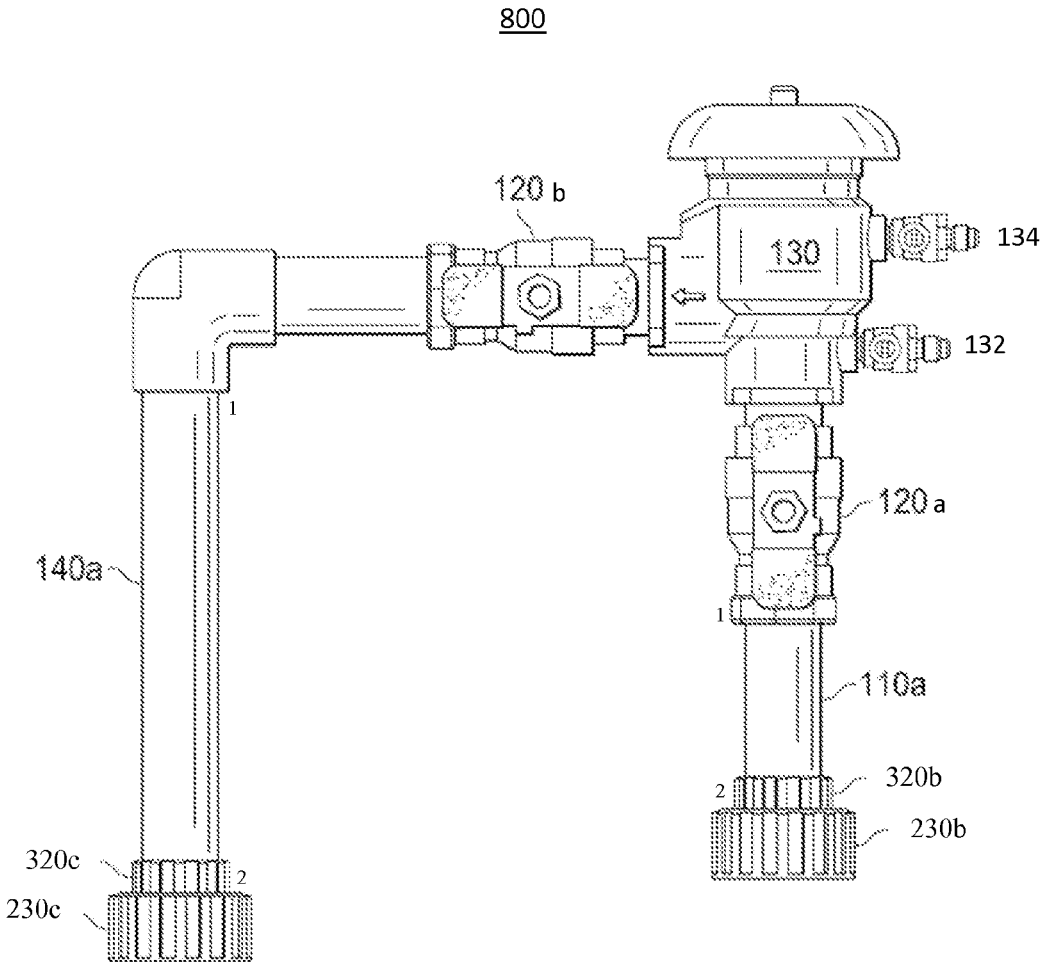
FIG. 8 shows a removable backflow prevention assembly in accordance with one or more embodiments of the present invention.

FIG. 8 shows a removable backflow prevention assembly 800 in accordance with one or more embodiments of the present invention. As noted above, removable water inlet pipe 110*a*, inlet shutoff valve 120*a*, backflow preventer 130, outlet shutoff valve 120*b*, removable water outlet pipe 140*a*, and any other piping that may fluidly connect them are referred to collectively as a backflow prevention assembly. A removable backflow prevention assembly 800 may be formed by fixedly attaching a few pieces to the backflow prevention assembly. A fixed union end piece 320*b* may be fixedly attached to a second end of removable water inlet pipe 110*a* by, for example, disposing glue (not shown) around an exterior of the second end of the removable water inlet pipe 110*a* and inserting the second end of the removable water inlet pipe 110*a* into an aperture of the bottom distal end of the fixed union end piece 320*b* through an aperture of a union mating adapter 230*b*. Another fixed union end piece 320*c* may be fixedly attached to a second end of removable water outlet pipe 140*a* by, for example, disposing glue (not shown) around an exterior of the second end of the removable water outlet pipe 140*a* and inserting the second end of the removable water outlet pipe 140*a* into an aperture of the bottom distal end of the fixed union end piece 320*c* through an aperture of another union mating adapter 230*c*. The removable backflow prevention assembly 800 now has connectors that allow for the easy attachment and removal from union-type ends.

Advantageously, with the removable backflow prevention assembly 800 removed from the fixed water inlet pipe 110*a* and the fixed water outlet pipe 140*a*, the inlet shutoff valve 120*a*, the outlet shutoff valve 120*b*, and/or the backflow preventer 130 may be more easily removed and replaced from the assembly than in the case of the conventional backflow prevention system 100. For example, the inlet shutoff valve 120*a* and the outlet shutoff valve 120*b* have threaded ends that, with removable backflow prevention assembly 800, may be more easily unscrewed and replaced than in the case of the conventional backflow prevention system 100 that is hard plumbed and fixed in place. In addition, the backflow preventer 130 have threaded ends that, with removable backflow prevention assembly 800, may also be more easily unscrewed and replaced than in the case of the hard plumbed conventional backflow prevention system 100.

Figure 9:
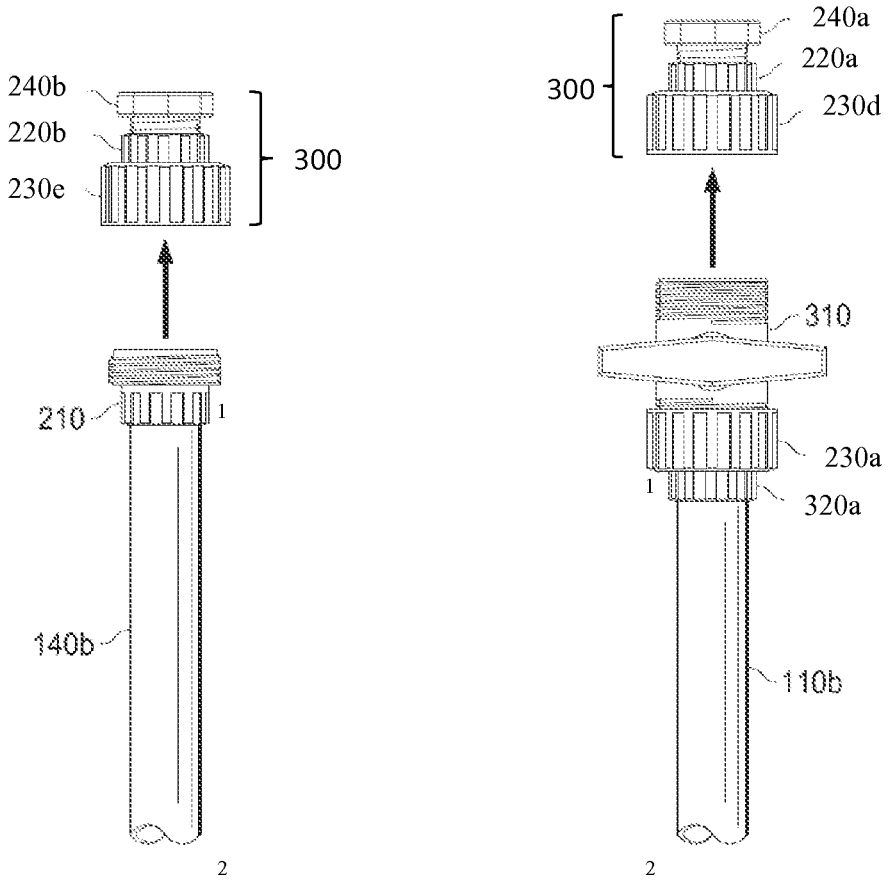
FIG. 9 shows the removal of the capping assemblies in preparation for attaching the removable backflow prevention assembly in accordance with one or more embodiments of the present invention.

FIG. 9 shows the removal of the capping assemblies 300 in preparation for attaching the removable backflow prevention assembly (800 of FIG. 8) in accordance with one or more embodiments of the present invention. When the owner desires to attach the removable backflow prevention assembly (800 of FIG. 8) and use the sprinkler system, the capping assemblies 300 may be removed from the fixed water inlet pipe 110*b* and the fixed water outlet pipe 140*b*. The capping assembly 300 for the fixed water inlet pipe 110*b* may be removed by unscrewing the union mating adapter 230*d* that is removably attached to the second union end of the inline ball valve 310 and removing the union mating adapter 230*d*, removable union end piece 220*a*, and removable cap 240*a*. The capping assembly 300 for the fixed water outlet pipe 140*b* may be removed by unscrewing the union mating adapter 230*e* that is removably attached to the fixed union end piece with seal 210 and removing the union mating adapter 230*e*, removable union end piece 220*b*, and removable cap 240*b*. The fixed water inlet pipe 110*b* and the fixed water outlet pipe 140*b* are now ready to receive the removable backflow prevention assembly (800 of FIG. 8).

Figure 10:
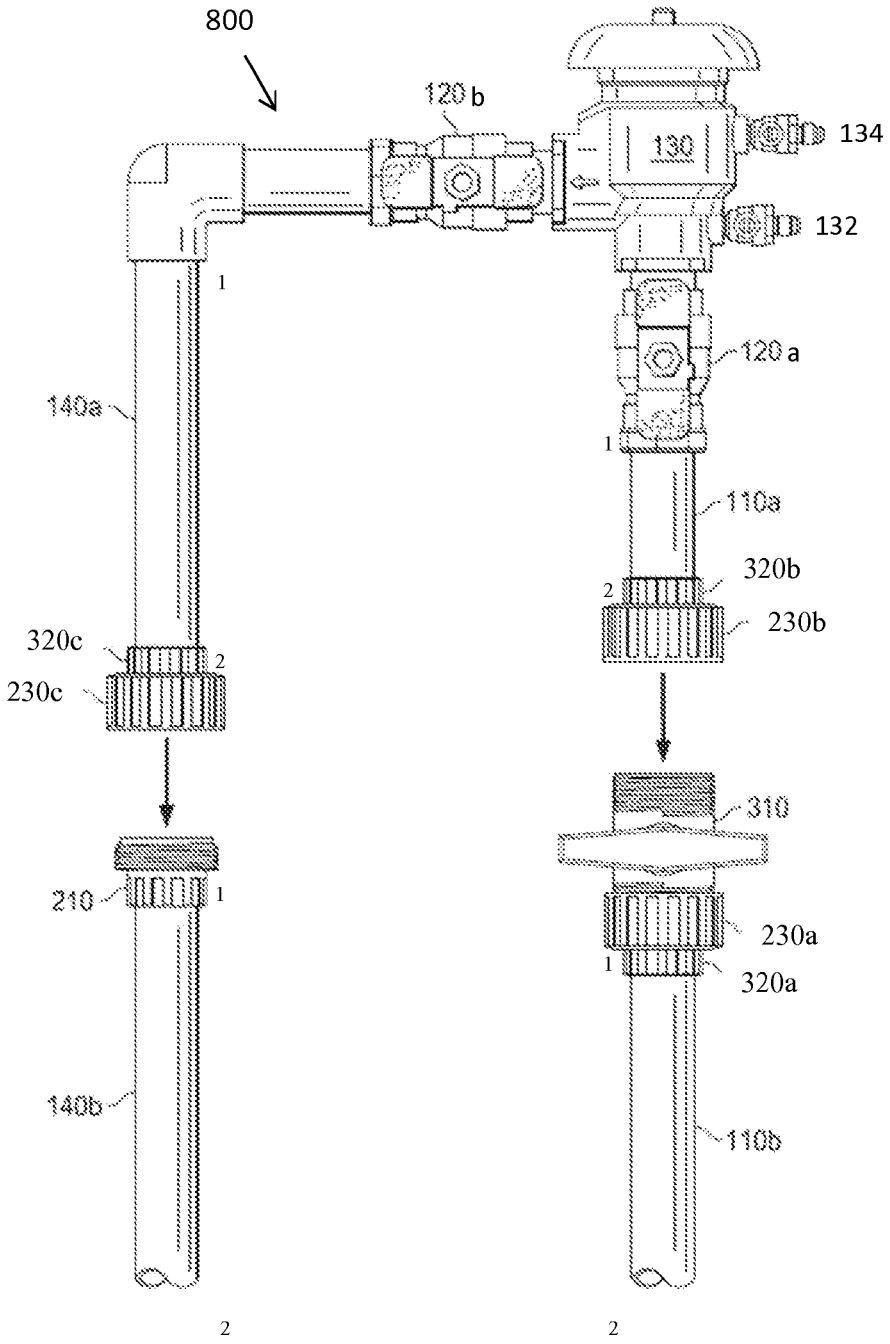
FIG. 10 shows how the removable backflow prevention assembly may be removably attached to the fixed water inlet pipe and the fixed water outlet pipe in accordance with one or more embodiments of the present invention.

FIG. 10 shows how the removable backflow prevention assembly 800 may be removably attached to the fixed water inlet pipe 110*b* and the fixed water outlet pipe 140*b* in accordance with one or more embodiments of the present invention. The removable backflow prevention assembly 800 may be removably attached to the fixed water inlet pipe 110*b* by removably attaching the union mating adapter 230*b* attached to the removable water inlet pipe 110*a* to the second union end of inline ball valve 310. The union mating adapter 230*b* may be removably attached by screwing the union mating adapter 230*b* and the second union end of inline ball valve 310 together. The removable backflow prevention assembly 800 may be removably attached to the fixed water outlet pipe 140*b* by removably attaching the union mating adapter 230*c* attached to the removable water outlet pipe 140*a* to the fixed union end piece with seal 210. The union mating adapter 230*c* may be removably attached by screwing the union mating adapter 230*c* and the fixed union end piece with seal 210 together.

Figure 11:
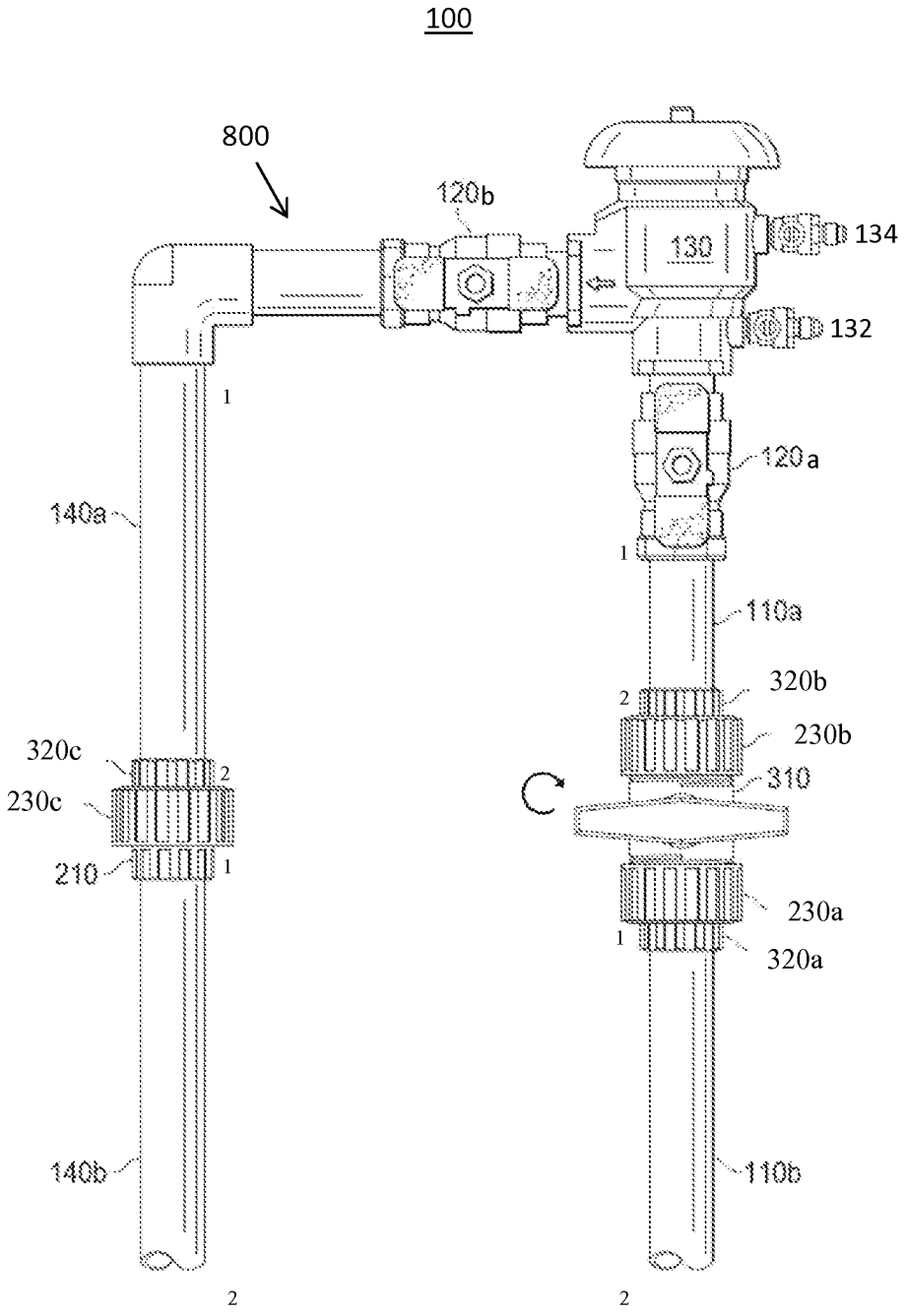
FIG. 11 shows the removable backflow prevention assembly removably attached to the fixed water inlet pipe and the fixed water outlet pipe in accordance with one or more embodiments of the present invention.

FIG. 11 shows a modular backflow prevention system 100 in accordance with one or more embodiments of the present invention. The modular backflow prevention system 100 includes a removable backflow prevention assembly 800 removably attached to the fixed water inlet pipe 110*b* and the fixed water outlet pipe 140*b*. Once the removable backflow prevention assembly 800 is removably attached, the handle of the inline ball valve 310 may be turned from the closed position (shown) to the open position (not shown) that allows water from the water supply to flow through the fixed water inlet pipe 110*b*, the removable backflow prevention assembly 800, the fixed water outlet pipe 140*b* and out to the sprinkler system downstream (not shown).

In one or more embodiments of the present invention, a method (not independently illustrated) of modularizing a backflow prevention assembly of a sprinkler system may convert a conventional backflow prevention system into a modular backflow prevention system. The method may include turning off the water supply to the backflow prevention system using a master shutoff valve. The sprinkler system may be run to evacuate water in the sprinkler system. The test cocks of the backflow preventer may be opened to drain any remaining water in the backflow preventer. The water inlet pipe may be cut forming a fixed water inlet pipe and a removable water inlet pipe. The water outlet pipe may be cut forming a fixed water outlet pipe and a removable water outlet pipe. The backflow prevention assembly may then be removed. A first fixed union end piece may be fixedly attached to a first end of the fixed water inlet pipe through a first union mating adapter, where a second end of the fixed water inlet pipe is in fluid communication with a water supply. A first fixed union end piece with seal may be attached to a first end of the fixed water outlet pipe, wherein a second end of the fixed water outlet pipe is in fluid communication with the sprinkler system.

A second fixed union end piece may be fixedly attached to a second end of the removable water inlet pipe through a second union mating adapter. A third fixed union end piece may be fixedly attached to a second end of the removable water outlet pipe through a third union mating adapter. The backflow prevention assembly may include a backflow preventer that includes an inlet port and an outlet port. The backflow prevention assembly also includes an inlet shutoff valve, where a first port of the inlet shutoff valve is in fluid communication with the inlet port of the backflow preventer and a second port of the inlet shutoff valve is in fluid communication with a first end of the removable water inlet pipe. The backflow prevention assembly also includes an outlet shutoff valve, where a first port of the outlet shutoff valve is in fluid communication with the outlet port of the backflow preventer and a second port of the outlet shutoff valve is in fluid communication with a first end of the removable water outlet pipe.

The now removable backflow prevention assembly may be removably attached to the first end of the fixed water inlet pipe and the first end of the fixed water outlet pipe by removably attaching the second union mating adapter to a second union end of the inline ball valve and removably attaching the third union mating adapter to the first fixed union end piece with seal. When the removable backflow prevention assembly is removed, the fixed water inlet pipe may be capped by a fixed water inlet pipe capping assembly. The fixed water inlet pipe capping assembly includes a first removable cap removably attached to a first removable union end piece through a fourth union mating adapter, where the fourth union mating adapter is removably attached to the second union end of the inline ball valve. The fixed water outlet pipe may be capped by a fixed water outlet pipe capping assembly. The fixed water outlet pipe capping assembly may include a second removable cap removably attached to a second removable union end piece through a fifth union mating adapter, where the fifth union mating adapter is removably attached to the fixed union end piece with seal.

Advantages of one or more embodiments of the present invention may include one or more of the following:

In one or more embodiments of the present invention, a modular backflow prevention system allows for the easy removal and attachment of a removable backflow prevention assembly.

In one or more embodiments of the present invention, a modular backflow prevention system allows a removable backflow prevention assembly to be easily removed from the water inlet and outlet pipes for storage in a garage or house.

In one or more embodiments of the present invention, a modular backflow prevention system allows for the removal and storage of a removable backflow prevention assembly that provides full-proof protection against freezing conditions.

In one or more embodiments of the present invention, a modular backflow prevention system allows a removable backflow prevention assembly to be easily attached to the water inlet and outlet pipes for normal operation of the sprinkler system.

In one or more embodiments of the present invention, a method of modularizing a backflow prevention assembly allows for the conversion of a conventional backflow prevention assembly into a removable backflow prevention assembly.

In one or more embodiments of the present invention, a method of modularizing a backflow prevention assembly does not require plumbing expertise and is relatively easy to implement.

In one or more embodiments of the present invention, a method of modularizing a backflow prevention assembly is no more difficult than replacing a failed backflow preventer.

In one or more embodiments of the present invention, a method of modularizing a backflow prevention assembly uses off-the-shelf components that are readily available and inexpensive.

In one or more embodiments of the present invention, a method of modularizing a backflow prevention assembly costs less than replacing a failed backflow preventer.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of modularizing a backflow prevention assembly of a sprinkler system comprising:

cutting a water inlet pipe forming a fixed water inlet pipe and a removable water inlet pipe;

cutting a water outlet pipe forming a fixed water outlet pipe and a removable water outlet pipe;

removing the backflow prevention assembly;

attaching a first fixed union end piece to a first end of the fixed water inlet pipe through a first union mating adapter, wherein a second end of the fixed water inlet pipe is in fluid communication with a water supply;

removably attaching a first union end of an inline ball valve to the first union mating adapter;

attaching a first fixed union end piece with a seal to a first end of the fixed water outlet pipe, wherein a second end of the fixed water outlet pipe is in fluid communication with the sprinkler system;

attaching a second fixed union end piece to a second end of the removable water inlet pipe through a second union mating adapter;

attaching a third fixed union end piece to a second end of the removable water outlet pipe through a third union mating adapter; and capping the fixed water inlet pipe by removably attaching a fourth union matting adapter to a second union end of the inline ball valve and removably attaching a first removable cap to a first removable union end piece through the fourth union mating adapter.

2. The method of claim 1, further comprising:

turning off the water supply;

running the sprinkler system to evacuate water in the sprinkler system; and opening a first and a second test cock of the backflow preventer to drain any remaining water.

3. The method of claim 1, wherein the backflow prevention assembly comprises:

a backflow preventer comprising an inlet port and an outlet port;

an inlet shutoff valve, wherein a first port of the inlet shutoff valve is in fluid communication with the inlet port of the backflow preventer and a second port of the inlet shutoff valve is in fluid communication with a first end of the removable water inlet pipe; and an outlet shutoff valve, wherein a first port of the outlet shutoff valve is in fluid communication with the outlet port of the backflow preventer and a second port of the outlet shutoff valve is in fluid communication with a first end of the removable water outlet pipe.

4. The method of claim 1, wherein the backflow prevention assembly is removably attached to the first end of the fixed water inlet pipe and the first end of the fixed water outlet pipe by removably attaching the second union mating adapter to a second union end of the inline ball valve and removably attaching the third union mating adapter to the first fixed union end piece with the seal.

5. The method of claim 1, further comprising:

capping the fixed water outlet pipe by removably attaching a fifth union mating adapter to the fixed union end piece with the seal and removably attaching a second removable cap to a second removable union end piece through the fifth union mating adapter.

6. The method of claim 1, wherein the backflow preventer is a pressure vacuum breaker backflow preventer.

7. The method of claim 1, wherein the backflow preventer is a double check valve backflow preventer.

8. The method of claim 1, wherein the backflow preventer is a reduced pressure zone backflow preventer.

* * * * *